United States Patent [19]

Billberg

[11] Patent Number: 4,655,386

[45] Date of Patent: Apr. 7, 1987

[54] PACKING CONTAINER BLANK AND CONTAINER MADE THEREFROM

[75] Inventor: Alf Billberg, Oxie, Sweden

[73] Assignee: Tetra Pak International AB, Lund, Sweden

[21] Appl. No.: 815,756

[22] Filed: Jan. 2, 1986

Related U.S. Application Data

[63] Continuation of Ser. No. 654,525, Sep. 25, 1984, abandoned, which is a continuation of Ser. No. 404,408, Aug. 2, 1982, abandoned.

[30] Foreign Application Priority Data

Aug. 27, 1981 [SE] Sweden ..... 8105070

[51] Int. Cl.[4] ..... B65D 5/72

[52] U.S. Cl. ..... 209/17 G; 229/3.1; 229/DIG. 9

[58] Field of Search ..... 229/17 R, 17 G, 3.1, 229/DIG. 9

[56] References Cited

U.S. PATENT DOCUMENTS

| | | | |
|---|---|---|---|
| 1,183,744 | 5/1916 | Leach . | |
| 2,047,625 | 7/1936 | Geerlings | 229/DIG. 9 |
| 2,362,862 | 11/1944 | Sidebottom | 229/37 R |
| 2,675,956 | 4/1954 | Currie | 229/DIG. 9 |
| 2,969,905 | 1/1961 | Braun . | |
| 2,987,176 | 6/1961 | Ringler | 229/DIG. 9 |
| 3,003,675 | 10/1961 | Ringler | 229/DIG. 9 |
| 3,186,621 | 6/1965 | Suensson | 229/17 G |
| 3,378,187 | 4/1968 | Sherrill et al. | 229/DIG. 9 |
| 3,399,820 | 9/1968 | Foster et al. | 229/17 G X |
| 3,474,951 | 10/1969 | Egleston et al. | 229/17 G |
| 3,490,678 | 1/1970 | James et al. | 229/17 G |
| 3,498,524 | 3/1970 | Braun | 229/17 G |
| 3,604,613 | 9/1971 | Haas et al. . | |
| 3,956,046 | 5/1976 | Tsuchiya et al. . | |
| 3,985,287 | 10/1976 | Stetler | 229/DIG. 9 |
| 4,190,190 | 2/1980 | Halonen | 229/17 R |
| 4,211,357 | 7/1980 | Lisiecki | 229/17 G |
| 4,332,345 | 6/1982 | Moran | 229/17 R |

FOREIGN PATENT DOCUMENTS

| | | | |
|---|---|---|---|
| 1193790 | 3/1959 | Fed. Rep. of Germany . | |
| 1939041 | 2/1971 | Fed. Rep. of Germany | 229/17 G |
| 758928 | 1/1934 | France . | |
| 1315595 | 12/1962 | France | 229/17 G |
| 583500 | 10/1958 | Italy | 229/17 G |
| 423612 | 5/1967 | Switzerland | 229/17 R |
| 630622 | 10/1949 | United Kingdom | 229/17 G |
| 1281177 | 7/1969 | United Kingdom . | |
| 2099402 | 12/1982 | United Kingdom | 229/17 G |

*Primary Examiner*—George E. Lowrance
*Assistant Examiner*—Gary E. Elkins
*Attorney, Agent, or Firm*—Burns, Doane, Swecker & Mathis

[57] ABSTRACT

Packing container blanks for gable-top packages are cut out of a material web which, up to now, has caused an appreciable amount of waste material, since the edges of the blanks are irregular and cannot be "dovetailed" into one another. A packing container blank is provided with partly straight, parallel lateral edges (11,12), and partly transverse edges (11,12) which are indented according to a regular pattern which is repeated over the width of the blank. As a result of the indentations, the edges of the blanks too can be formed without wastage.

8 Claims, 5 Drawing Figures

PACKING CONTAINER BLANK AND CONTAINER MADE THEREFROM

This application is a continuation of application Ser. No. 654,525, filed Sept. 25, 1984, now abandoned, which is a continuation of application Ser. No. 404,408, filed Aug. 2, 1982, now abandoned.

BACKGROUND AND SUMMARY OF THE PRESENT INVENTION

The present invention relates generally to a packing container blank. More specifically, the present invention relates to a packing container blank having two straight, parallel lateral edges and two notches transverse edges. The invention also relates to a method for the manufacture of the packing container blank and a packing container made from the blank.

Packing containers for the packing of liquid foodstuffs exist in a number of different types. One of the more usual is the so-called gable-top type which is in the main of parallelepipedic shape, but has a ridgelike top with a traverse sealing fin directed upwards. At present the same type of package also exists with the fin folded down and a substantially plane top. The packing container is manufactured from a flexible laminate which includes a carrier layer of paper and external liquid-tight plastic layers including possible further layer of e.g. aluminum foil. The laminated material is fed in the form of individual blanks to the packing machine where the packing containers are formed, filled and sealed. The blanks have previously been folded and sealed so that they obtain a tubular shape of substantially square cross-section. Stacks of such shaped blanks in flattened condition are supplied to the packing machine which subsequently raises them to tubular shape and provides them with bases. During successive transfer through the packing machine the blanks are filled with contents, e.g. milk, whereupon they are closed in that the top is formed and sealed.

The blanks from which the packing containers are manufactured are constituted of material sheets which have been detached from a continuous web of packing material and have been given an outer contour which is adapted to the size and shape when the finished packing container is intended to have. For the type of packing container described, that is to say gable-top packages, the sheet is given a substantially four-sided main shape, with only two of the lateral edges of the sheet, however, being straight. The two other opposite edges have an uneven edge line with projecting portions of material, which in the subsequent conversion of the sheet to a finished packing container are intended to form the sealing fin directed upwards, and overlapping sealing lugs at the bottom of the packing container. These non-uniform edges are a great and serious disadvantage, since owing to their irregularity they make impossible a rational cutting out of the blanks edge-in-edge with each other, and cause an appreciable amount of waste material. This not only brings about increased material costs but also renders the manufacture extremely difficult, since the wastage in the form of individual small bits of material constantly has to be removed and taken care of, so as not to disturb the production.

Various attempts have been made in the past to solve this problem by making the edges more uniform or reducing in some other manner the wastage on punching out the blanks. However, no acceptable solution has been suggested, and this is probably due to the fact that not only has the cutting out to be facilitated, but the blanks must also be provided with edges permitting the manufacture of packing containers without increased risk of leakage at the top or bottom. Thus it was necessary to avoid designing the blanks in such a way that the area of the available sealing surfaces, which are used for the sealing of the packing container, would be reduced.

It is an object of the present invention to provide a packing container blank of such a shape that the above-mentioned disadvantages are avoided.

It is a further object of the present invention to provide a packing container blank on which opposite edges are formed according to a repeatable identical pattern, so that the blanks can be punched out in continuous manufacture from a web without waste material being produced.

It is a yet further object of the present invention to provide a packing container blank of such a shape that the surfaces, which during the conversion of the blank to a packing container are to be used for sealing of the material, are given maximum size and optimum shape.

These and other objects have been achieved in accordance with the invention in that a packing container blank having two straight parallel, lateral edges and two transverse edges is given the characteristic that the transverse edges are indented or notched according to a pattern which is repeated over the width of the blank.

Preferred embodiments of the packing container blank in accordance with the invention have been given, moreover, the characteristics which are evident from the description below.

By giving the transverse edges of the packing container blank a notched pattern which is repeated over the width of the blank the possibility is provided of cutting the blanks during continuous manufacture through punching the same from a web in such a manner that waste material can be wholly avoided. Since, thanks to the design of the blank in accordance with the invention, the notched, transverse edges on two blanks adjoining each other can now be cut by a common cut, similarly to the two straight, parallel lateral edges, the creation of waste material, which had to be taken care of during the production, is wholly avoided, which makes possible an appreciable increase in the rate of manufacture.

A packing container made from the packing container blank in accordance with the invention has been given the characteristic in accordance with the invention that it includes four wall panels which in pairs have the same outer contours or profiles. Owing to opposite pairs of wall panels being alike a symmetrical packing container is obtained, which rationalizes and simplifies the transport and the steering of the packing container blank through the packing machine as well as the forming of the packing container.

It is a still further object of the present invention to provide a method for manufacturing blanks from a packing material web in the most material-saving manner possible.

This object has been achieved in accordance with the invention in that a method for manufacturing blanks from a packing material web has been given the characteristic in accordance with the invention that the packing material web is cut according to a pattern which at the same time forms a transverse edge of a first blank as well as a transverse edge of a second adjoining blank.

Preferred embodiments of the method in accordance with the invention, moreover, have been given the characteristics which are evident from the description below.

Thanks to the method in accordance with the invention the cutting is facilitated and the design of the cutting elements is simplified, which gives rise to less expensive manufacture and fewer interruptions because of faulty or damaged cutting elements.

BRIEF DESCRIPTION OF THE DRAWINGS

Preferred embodiments of the invention will now be described in detail with special reference to the attached drawings which show schematically a packing container and a packing container blank in accordance with the invention. Only the details required for the understanding of the invention have been included.

DETAILED DESCRIPTION OF THE PREFERRED EMBODIMENTS

Figure 1:
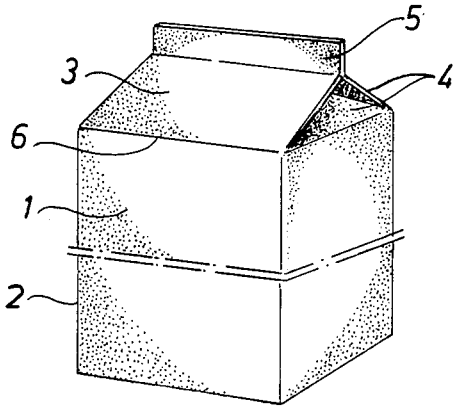
FIG. 1 is a perspective view of a packing container of the so-called gable-top type which is manufactured in accordance with the invention.
Figure 2:
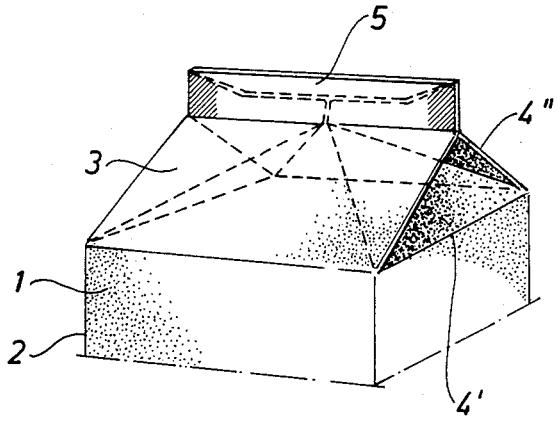
FIG. 2 is an enlarged perspective view of the upper end of the packing container in accordance with FIG. 1 and illustrates by broken lines the internal folding of the upper end of the packing container blank.

The packing container shown in FIG. 1 is of the gable-top type and thus includes a substantially parallelepipedic main body which at the top is designed with a ridgelike upper part. The main part of the packing container consists of four rectangular side wall panels 1, which are separated from each other by vertical crease lines 2. At the upper end of the side wall panels are, on the one hand rectangular main top panels 3 sloping towards each other, and on the other hand triangular backfolding panels 4 folded-in between the top panels 3. The main top panels 3 as well as the backfolding panels 4 are delimited from the side wall panels 2 by a transverse crease line 6. At the top of the main top panels 3 a transverse sealing fin 5 is provided wherein the upper ends of the different top panels are sealed together in a liquid-tight manner, made evident more clearly in FIG. 2. FIG. 2 illustrates the internal construction of the top of the packing container.

Similarly to the top of the packing container the base too includes a number of material panels separated by crease lines, which through folding and sealing together form a liquid-tight flat base. Thus two opposite substantially rectangular main bottom panels 7 are present at the lower end of the packing container. Inside them are a number of triangular backfolding panels 8 which are sealed to the main bottom panels 7. The construction of the top as well as of the base will be described in greater detail in the following.

Figure 3:
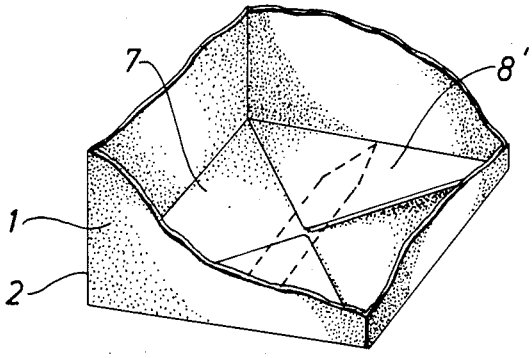
FIG. 3 is an enlarged perspective view of a part of the bottom end of the packing container in accordance with FIG. 1 and illustrates the internal formation of the base.
Figure 4:
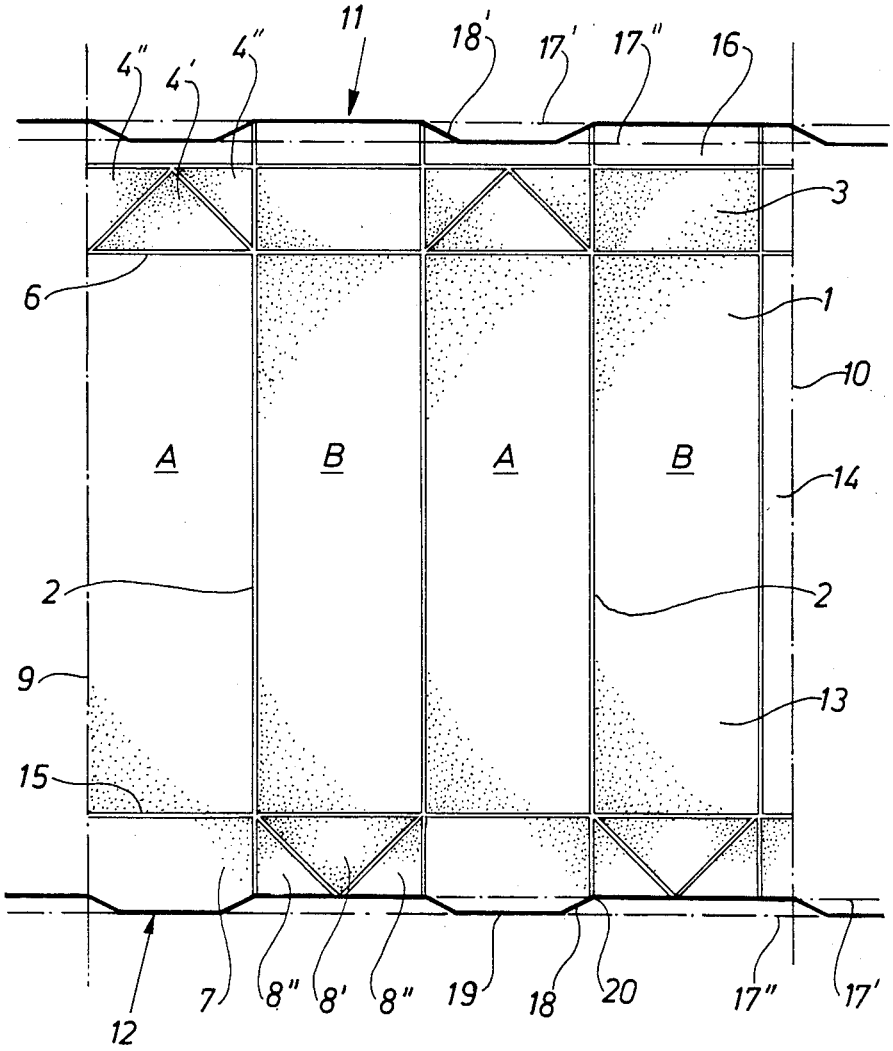
FIG. 4 is a plan view of a first embodiment of a packing container blank in accordance with the invention, the placing of the blank in a material web in relation to the surrounding packing container webs being indicated.

In FIG. 4 is shown a first embodiment of a packing container blank in accordance with the invention for the manufacture of the packing container shown in FIGS. 1–3. As can be seen from the figure the packing container blank constitutes originally part of a broader material web from which a number of identical packing container blanks are formed through cuts in the edge lines indicated. (The placing of adjoining packing container blanks is indicated partly by thinner contour lines). The packing container blank cut out is four-sided and includes two straight, parallel lateral edges 9 and 10 and two transverse edges 11 and 12 extending between the lateral edges 9 and 10. The two transverse edges 11,12 are not straight but are notched or indented according to a pattern which is repeated over the width of the blank, as will be explained in greater detail in the following. Parallel with the two lateral edges 9,10 extend the longitudinal crease lines 2 over the packing container blank and divide the same into four wall panels 13. Each wall panel 13 includes two parallel lateral edges or crease lines and two transverse edges, which coincide with the transverse edges 11,12. The wall panels 13 are of two main types which in the drawing are indicated by A and B respectively. Outside one of the two outer wall panels 13 a longitudinal sealing panel 14, is provided separated by one of the crease lines 2. The sealing panel 14 is sealed to the opposite wall panel 13A along the lateral edge 9 when the packing container blank is to be converted to tubular form.

Each of the wall panels 13 is provided with further crease lines which divide the wall panels into different panels, which are folded or sealed so as to form different wall panels of the packing container when the packing container blank is to be converted to a finished packing container. With the help of the upper transverse crease line 6 mentioned earlier, which extends over all the wall panels 13 at a right angle to the vertical crease lines 2, and a corresponding lower transverse crease line 15, the centrally situated side wall panels 1 are separated from the wall panels which form the upper part or top and the bottom respectively of the packing container. Each of the two wall panels 13A thus will include a side wall panel together with the substantially rectangular main bottom panel 7 having a tab portion, separated at its lower end by the lower transverse crease line 15, and the backfolding panels 4 separated at the upper end of the side wall panel 1 by the upper transverse crease line 6. The triangular backfolding panels 4 include a central backfolding panel 4' and two likewise triangular backfolding panels 4'' situated on either side.

Each of the two wall panels 13B likewise includes a central side wall panel 1 which at its lower end is separated by the lower transverse crease line 15 from the triangular backfolding panels 8 which, similarly to the backfolding panels at the upper end of the packing container blank, include a central backfolding panel 8' and backfolding panels 8'' situated on either side of the same. At the upper end of the side wall panel 1 the wall panels 13B include the rectangular main top panel 3, which is delimited from the side wall panel 1 by an upper transverse crease line 6. Above the main top panel 3 and the upper backfolding panel 4 there is a further sealing panel 16 extending transversely, which is used for sealing the top part of the package and forming the sealing fin 5. Usually the packing container blank is provided with further crease lines to permit e.g. the folding out and forming of a pouring spout on the finished packing container, but these crease lines are conventional and of no importance for the invention, so that, for the sake of clarity, they are not shown on the drawings.

As is clearly evident from FIG. 4 the upper as well as the lower transverse edges 11,12 are notched according to a regular pattern repeated over the width of the blank. More particularly, each transverse edge 11,12 extends alternatingly along two parallel boundary lines 17',17" situated at a slight distance from each other which are indicated as dot-dash lines on the drawing. The two boundary lines 17',17" meet or cross the longitudinal crease lines 2 so that the boundary lines are divided into several smaller parts. These parts are usually situated straight in front of one another, so that the boundary lines will be straight and unbroken, but it is also possible for the different parts of each boundary line to be somewhat displaced in relation to one another, if e.g. for reasons of sealing technique it is not desired to place the edge lines of the blank directly in front of one another which might have a negative effect on the tightness of the finished packing container (explained more fully in the following). The displacement is slight (1–3 mm) and the boundary lines may therefore still be considered to be practically straight. Each of the two transverse edges 11,12 thus extends along one boundary line 17', along a first wall panel 13B, to continue on the adjoining wall panel 13A partly along the second boundary line 17", partly along the sloping transition lines 18, which link together the two two boundary lines 17',17" to create tabs and indentations. This pattern is repeated on opposite edges of the blank so that the two wall panels 13B are delimited at both ends by straight parts of the transverse edges 11,12 extending along the boundary lines 17', while the two wall panels 13A are delimited along a central portion 19 at both ends by parts of the transverse edges 11,12 extending along the two boundary lines 17" and on either side of the central portion 19 by sloping transition lines 18. The two ends of the panels 13A are delimited thus by parts of the two transverse edges 11,12 which partly extend along the boundary line 17" (the central portion 19) partly along the sloping transition lines 18, which connect the central portion 19 to points of intersection 20 between boundary lines 17' and the crease lines 2 extending between the wall panels 13.

Figure 5:
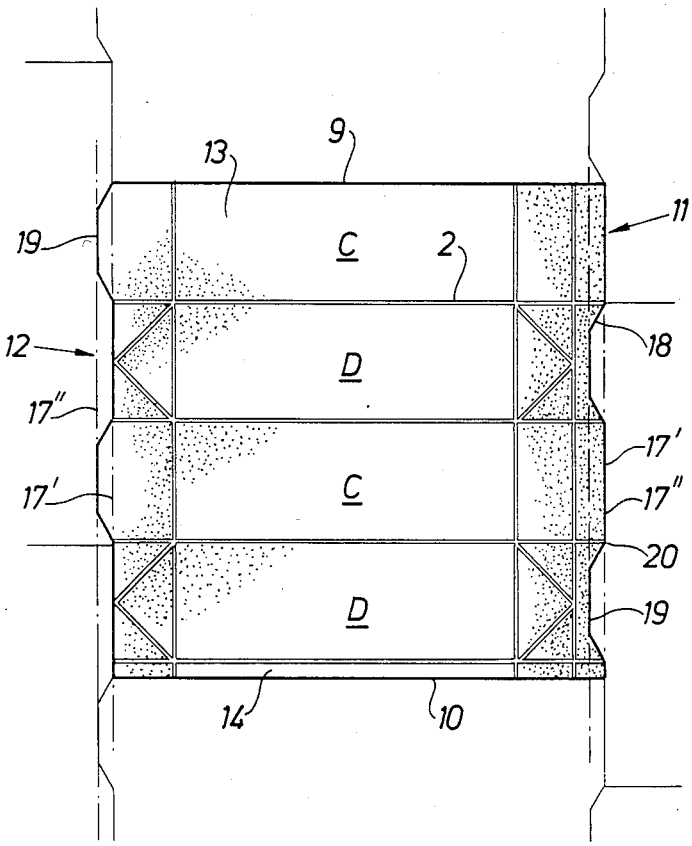
FIG. 5 is a plan view of a second embodiment of a packing container blank in accordance with the invention as placed on a packing material web where it is surrounded by further packing container blanks of the same type, whose adjoining edges are indicated by thin lines.

If the packing container blank in accordance with FIG. 4 is considered as a whole it will be seen that the two different wall panel types A and B occur alternatingly. This means that the pattern on the one transverse edge 11 is repeated on the opposite transverse edge 12. According to a second embodiment of the packing container blank in accordance with the invention it is also possible, however, to displace the pattern on the one transverse edge in relation to the pattern on the opposite transverse edge while retaining the mutual identity of the patterns. This is illustrated in FIG. 5 where a packing container blank of a second embodiment is shown schematically together with parts of adjoining, identical packing container blanks in a wider material web. Similarly to the packing container blank shown in FIG. 4 the packing container blank according to FIG. 5 is cut so that the two parallel lateral edges 9,10 delimit the blank in one direction while the notched transverse edges 11,12 delimit the blank at the opposite sides. The packing container blank according to FIG. 5 has a similar crease line pattern as the packing container blank according to FIG. 4, that is to say it is divided by mutually parallel crease lines 2 into four wall panels 13 laterally adjoining each other, which are identical in pairs and are designated 13C and 13D respectively. However, contrary to what is the case in the packing container blank according to FIG. 4, the main top panels 3 and the main bottom panels 7 (for better understanding the same reference numerals have been used as far as possible for both embodiments) are situated at opposite ends of the same wall panel type (C) while the backfolding panels at the top as well as at the bottom ends are situated at opposite ends of the other wall panel type 13D.

The upper and the lower transverse edges 11 and 12 respectively of the packing container blank are notched according to a similar pattern which is regular and is repeated over the width of the blank. However, the pattern on the one transverse edge 11 is displaced in relation to the pattern on the opposite transverse edge 12 so that each individual wall panel on its one end is delimited by a straight, transverse edge and on its opposite end is delimited by a notched or indented edge. The edge pattern on one end of each wall panel thus has its counterpart on the opposite end of the adjoining wall panel, which is the reverse of what was the case in the embodiment according to FIG. 4, where in fact the edge pattern on the end of each wall panel had its counterpart on the opposite end of the same wall panel. In other words the edge pattern of the embodiment according to FIG. 5 may be said to be identical on both edges, but displaced by one wall panel width.

The transverse edges 11,12 follow the same regular pattern as the corresponding transverse edges in the embodiment according to FIG. 4. In other words the the edges follow alternatingly the one boundary line 17' and the other boundary line 17" together with the sloping transition lines 18 situated in between. At the upper end of the packing container blank the transverse edge 11 runs along the one boundary line 17' over the wall panels 13C to continue over the wall panels 13D partly along the other boundary line 17", partly along the sloping transition lines 18 which connect the central portion of the edge line running along the boundary line 17" to the points of intersection 20 between the boundary line 17' and the crease lines 2 separating the wall panels 13. At the lower end of the packing container blank the two wall panels 13 of type D have a straight edge 12 which extends along the boundary line 17' while the two wall panels 13C have an edge line which over a central portion 19 extends along the boundary line 17" to continue on either side of this central portion in the direction towards the point of intersection between the boundary line 17' and the crease lines 2.

Owing to the special design of the two transverse edges 11,12 a cutting out of packing container blanks from a material web or a larger material sheet is made possible without any wastage of excess material between the different packing container blanks occurring, since thanks to the regular edge pattern they fit into each other and can be cut by a common cut which at the same time forms one edge of a first packing material blank and a greater or smaller part of an opposite edge of another adjoining packing material blank. The two different embodiments of the packing material blank in accordance with the invention described are cut in different patterns. The first embodiment of the blank shown in FIG. 4 is cut with the two straight, parallel lateral edges 9,10 parallel with the longitudinal direction of the material web, that is to say, the material web can be imagined to run vertically in the plane of the drawing. Since the two transverse edges 11,12 of the packing container blank are formed according to regular, identical patterns which, moreover, are situated straight before each other, a notched edge of one packing container blank will wholly coincide with the opposite notched edge of the subsequent (or preceding) packing container blank, which makes it possible, by one transverse cut over the packing material web to form at the same time the lower transverse edge 12 of one packing container blank and the upper transverse edge 11 of the subsequent packing container blank. No wastage will occur in the course of this, since the edge profiles wholly coincide with one another. The lateral edges 9,10 of the blanks are straight, and here too it will be possible therefore to cut a lateral edge of one sheet at the same time as the opposite lateral edge of the adjoining sheet without wastage, so that an arbitrary number of blanks may be placed side by side over the width of the material web.

In the second embodiment of the packing container blank in accordance with the invention (FIG. 5) the material web from which the blank is made, likewise extends vertically in the plane of the drawing, that is to say the packing container blank is placed with the parallel lateral edges 9,10 and the crease lines 2 at an angle of 90° to the longitudinal direction of the material web. Here, though the notched transverse edges 11,12 will not correspond directly to the edge notches on the opposite edge of an adjoining blank, but the adjoining blank must be displaced over a distance which corresponds to the width of one wall panel 13. Owing to this displacement an arbitrary number of blanks can be placed side by side over the width of the material web and cut by common cuts which at the same time form the upper transverse edge 11 of one blank and the opposite transverse edge 12 of an adjoining blank. It is clear that in this embodiment a certain unavoidable wastage will occur at the outer edges of the material web, since these are straight and not notched corresponding to the edges 11 and 12 of the packing container blank. The cutting can be carried out without wastage between successive blanks on the material web if it follows the stepped line which the lateral edges 9,10 of the packing material sheets placed side by side describe. The orientation of a packing container blank on the material web, and hence the choice of the first or the second embodiment of the packing container blank in accordance with the invention is determined, among other things, by the way in which it is wished to place the fiber direction in relation to the packing container blank. The laminated material from which the packing container blank is manufactured includes, as mentioned before, a central carrier layer of a fibrous substance such as paper. During the manufacture of the paper the individual fibers entering the paper are oriented more or less automatically in the direction of discharge of the paper from the paper machine, that is to say the fibers will extend in the longitudinal direction of the web. In the embodiment according to FIG. 4 the fibers consequently will be oriented with their longitudinal axis in the longitudinal direction of the wall panels 13, i.e. vertically in the finished package, while in a packing container manufactured according to the other embodiment of the blank (FIG. 5) the fibers will be oriented horizontally in the packing container. Since this latter direction of orientation gives the side wall panels greater stiffness and therefore makes the packing container more stable to handle, it will generally be preferred. However, the vertical fiber orientation according to the first embodiment of the packing container blank allows easier forming of the upper, openable part of the package and can be desirable, therefore, in certain cases. The first embodiment, moreover, is somewhat simpler to manufacture at a faster rate, since the division of the wide material web is done by straight parallel cuts, which can be achieved at a very high working speed. Since the subsequent transverse division of the partial webs into individual packing container blanks takes place at an appreciably lower speed in connection with, or directly before, the conversion of the packing container material to individual packing containers, the notched transverse cutting lines in this case do not signify any disadvantage.

When the packing container blank in accordance with the invention is converted to individual packing containers of the gable-top type the four wall panels 13, as mentioned previously, form four side walls, opposed in pairs, of the packing container as well as the top and the bottom of the packing container. During the forming of the top of the packing container the different top panels are folded according to a conventional pattern in that the two backfolding panels 4' are folded down, using corresponding parts of the upper transverse crease line 6 as a hinge, in the direction towards each other and towards the centre axis of the packing container. As a result the backfolding panels 4'', located at the side, as well as the main top panels 3 connected with them are acted upon in direction towards each other. After the completed forming (FIG. 2) the two parts of the sealing panel 16 adjoining the main top panel 3 will rest partly against each other and partly against the intermediate parts of the sealing panel 16 adjoining the backfolding panels, so that the sealing fin 5 pointing upwards can be formed. The sealing together of the layers included in the fin takes place in conventional manner, that is to say by heating of the material until the thermoplastic outer layers of the same reach melting temperature, and subsequent joining and pressing together. In this type of packing container top there are above all two areas which are critical from a point of view of leakage, namely at the two ends of the sealing fin 5, where two double-folded parts of the sealing panel 16 are to be pressed together. It is in these areas, marked by broken lines in FIG. 2, that it is particularly difficult to prevent leakage along the folding lines in the sealing panel 16, since very fine channels tend to form "inside" the folds. The greater the length of the folding line available for sealing, the greater will be the possibility of preventing leakage along the folding line. Through the design of the packing container in accordance with the invention optimum possibilities of preventing leakage are provided, since all the parts of the sealing panel 16 included in the sealing fin 5 are of full height in these critical areas. This was not the case in earlier designs where the two parts of the sealing panel 16 adjoining the backfolding panels only retained about one half of the height out to the crease lines 2.

The design of the packing container in accordance with the invention also contributes to safer sealing and improved tightness owing to a further feature, namely the fact that the portions of the sealing panel 16 extending along the two sloping transition lines 18 have a different slope on the same wall panel. This means that these portions after forming of the packing container top, as can be seen in FIG. 2, are subjected to slightly different stretching. As a result of this, a direct and abrupt transition between double material thickness in the top part of the fin 5 to quadruple material thickness in the bottom part of the fin is avoided when the layers forming part of the sealing fin 5 are sealed to one another. A similar measure can also be adopted in other parts included in the sealing fin, e.g. by giving them a slightly different height (1–3 mm) which appreciably reduces the risk of leakage channels occurring along the lower portions of the sealing panel 16 forming part of the fin.

The bottom panel of the backing container is folded according to a substantially conventional pattern which involves acting upon the two opposing backfolding panels 8' in direction towards each other so that they turn about the lower transverse crease line 15 serving as a hinge. In the course of this the two main bottom panels 7 are also acted upon via the lateral, triangular backfolding panels 8'' in direction towards each other. After completed folding the two corners of the backfolding panels 8' situated at the inner boundary lines attain a position close to one another, while the two edges of the main bottom panel 7 extending along the outer boundary line overlap each other in a central area of the base of the packing container. After sealing, this design provides a completely tight and plane base which is free of leakage channels or other features critical from a point of view of tightness.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limited to the scope and spirit of the invention as set forth in the appended claims.

What is claimed is:

1. A one-piece blank foldable to form a packing container of the type having a gable top with a sealing fin extending along the top, comprising:

a laminated material having an overall rectangular shape with two straight, parallel lateral edges and first and second transverse edges;

said blank provided with four crease lines parallel to said lateral edges and dividing said blank into first, second, third and fourth sections of substantially equal width and a fifth section of reduced width;

two parallel crease lines adjacent the first transverse edge, said parallel crease lines being perpendicular to and extending continuously between the lateral edges of the blank;

wherein the material between the first transverse edge and the parallel crease line more adjacent the first transverse edge form the sealing fin of the packing container;

a single crease line adjacent the second transverse edge, said single crease line being perpendicular to and extending continuously between the lateral edges;

said first section and said third section each having a triangular backfolding panel between said two parallel crease lines;

said second section and said fourth section each having a triangular backfolding panel between said single crease line and said second transverse edge;

said first transverse edge having straight segments parallel to said two crease lines and spaced therefrom;

said straight segments of said first transverse edge located in the second and fourth sections being spaced a greater distance from said parallel crease lines than the straight segments of said first transverse edge located in the first and third sections;

said first transverse edge also having straight sloping transition segments along the first and third sections and between said straight segments;

said second transverse edge having straight segments parallel to said single crease line and spaced therefrom;

said straight segments of said second transverse edge located in the first and third sections being spaced a greater distance from said single crease line than the straight segments of said second transverse edge located in the second and fourth sections;

said second transverse edge also having straight sloping transition segments along the first and third sections and between said straight segments;

said straight and sloping transition segments of the first transverse edge being parallel to and conforming with said straight and sloping transition segments of the second transverse edge such that the first transverse edge of the one-piece blank can be cut from the second transverse edge of an identical one-piece blank with no scrap material being created therebetween;

that portion of the blank between said crease line near the second transverse edge forming the bottom of the container;

and the portion of the blank embracing said two parallel crease lines forming the gable top of the packing container;

wherein said sloping transition segments form a gradual transition in the sealing fin from a quadruple thickness at the bottom of the fin to a double thickness at the top thereof.

2. The one-piece blank according to claim 1 wherein said first and second transverse edges at said fifth section are aligned with said transverse edges at said fourth section.

3. The one-piece blank according to claim 1 wherein said four crease lines extend from said first transverse edge to said second transverse edge.

4. The one-piece blank according to claim 1 wherein a plurality of said blanks are joined continuously along said first and second transverse edges and along said lateral edges and upon cutting along said transverse and lateral edges, said blank is separated from adjacent blanks without forming scrap pieces of laminate.

5. A one-piece blank foldable to form a packing container of the type having a cable top with a sealing fin extending along the top, comprising:

a laminated material having an overall rectangular shape with two straight, parallel lateral edges and first and second transverse edges;

said blank provided with four crease lines parallel to said lateral edges and dividing said blank into first, second, third, fourth and fifth sections;

the fifth section having a width less than the first section and forming a sealing panel;

two parallel crease lines adjacent the first transverse edge, and a single crease line adjacent the second transverse edge, said crease lines being perpendicular to and extending to each of the lateral edges of the blank;

the material between the two parallel crease lines forming the gable top of the packing carton;

the material between the first transverse edge and the parallel crease line most adjacent the first transverse edge forming the sealing fin of the packing container;

the material between the single crease line and the second transverse edge forming the bottom of the packing container;

said transverse edges comprising straight segments in the second and fourth sections;

said first transverse edge having recessed segments in the center of the first and third sections with sloping edges interconnecting the recessed segments with the straight segments of the second and fourth sections;

said second transverse edge having extended segments in the first and third sections with sloping edges interconnecting the extended segments with the straight segments of the second and fourth sections;

said first transverse edge being parallel to and conforming with said second transverse edge such that the first transverse edge of the one piece blank can be cut from the second transverse edge of an identical one-piece blank with no scrap material being created therebetween;

wherein said sloping edges form a gradual transition in the sealing fin from a quadruple thickness at the bottom of the fin to a double thickness at the top thereof.

6. The one-piece blank according to claim 5, wherein said first, second, third and fourth sections are of equal width.

7. The one-piece blank according to claim 5, wherein the first and second transverse edges at the fifth section are aligned with the first and second transverse edges at said fourth section.

8. The one-piece blank according to claim 5, wherein said four crease lines extend from said first transverse edge to said second transverse edge.

* * * * *